US007131291B2

(12) United States Patent
Aflekt et al.

(10) Patent No.: US 7,131,291 B2
(45) Date of Patent: Nov. 7, 2006

(54) COMPRESSION SYSTEM FOR COOLING AND HEATING PURPOSES

(75) Inventors: Kåre Aflekt, Trondheim (NO); Arne Jakobsen, Trondheim (NO); Jostein Pettersen, Ranheim (NO); Geir Skaugen, Trondheim (NO); Armin Hafner, Trondheim (NO); Petter Nekså, Trondheim (NO); Håvard Rekstad, Trondheim (NO); Gholam Reza Zakeri, Bad Vilbel (DE)

(73) Assignee: Sinvent AS, Trondheim (NO)

( * ) Notice: Subject to any disclaimer, the term of this patent is extended or adjusted under 35 U.S.C. 154(b) by 216 days.

(21) Appl. No.: 10/488,230

(22) PCT Filed: Jul. 26, 2002

(86) PCT No.: PCT/NO02/00270

§ 371 (c)(1),
(2), (4) Date: Aug. 12, 2004

(87) PCT Pub. No.: WO03/021164

PCT Pub. Date: Mar. 13, 2003

(65) Prior Publication Data

US 2004/0255609 A1 Dec. 23, 2004

(30) Foreign Application Priority Data

Sep. 3, 2001 (NO) ..... 20014258

(51) Int. Cl.
*F25B 1/00* (2006.01)

(52) U.S. Cl. ..... 62/498

(58) Field of Classification Search ..... 62/228.3, 62/229, 244, 511, 513, 498, 602
See application file for complete search history.

(56) References Cited

U.S. PATENT DOCUMENTS

| | | | | |
|---|---|---|---|---|
| 5,245,836 | A * | 9/1993 | Lorentzen et al. | 62/174 |
| 5,497,631 | A * | 3/1996 | Lorentzen et al. | 62/115 |
| 5,685,160 | A * | 11/1997 | Abersfelder et al. | 62/114 |
| 6,105,386 | A * | 8/2000 | Kuroda et al. | 62/513 |
| 6,178,761 | B1 * | 1/2001 | Karl | 62/159 |
| 6,343,486 | B1 * | 2/2002 | Mizukami | 62/509 |
| 6,427,479 | B1 * | 8/2002 | Komatsubara et al. | 62/503 |
| 6,428,284 | B1 * | 8/2002 | Vaisman | 417/213 |
| 6,523,360 | B1 * | 2/2003 | Watanabe et al. | 62/204 |
| 6,588,223 | B1 * | 7/2003 | Dienhart | 62/228.3 |
| 6,591,618 | B1 * | 7/2003 | Howard et al. | 62/114 |
| 6,698,234 | B1 * | 3/2004 | Gopalnarayanan et al. | 62/505 |
| 6,786,057 | B1 * | 9/2004 | Ben Yahia | 62/222 |

FOREIGN PATENT DOCUMENTS

| | | |
|---|---|---|
| DE | 19832480 | 1/2000 |
| EP | 0860309 | 8/1998 |
| EP | 0978693 | 2/2000 |

(Continued)

*Primary Examiner*—Mohammad M. Ali
(74) *Attorney, Agent, or Firm*—Wenderoth, Lind & Ponack, L.L.P.

(57) ABSTRACT

A compression refrigeration system includes a compressor (1), a heat rejector (2), expansion device (3) and a heat absorber (4) connected in a closed circulation circuit that may operate with supercritical high-side pressure. The refrigerant charge and component design of the system corresponds to a stand still pressure inside the system which lower than 1.26 times the critical pressure of the refrigerant when the temperature of the whole system is equalized to 60° C. Carbon dioxide or a mixture of a refrigerant containing carbon dioxide may be applied as the refrigerant in the system.

10 Claims, 3 Drawing Sheets

FOREIGN PATENT DOCUMENTS

| | | | |
|---|---|---|---|
| EP | 1132457 | | 9/2001 |
| JP | 11-201568 A | * | 7/1999 |
| WO | WO 93/06423 | * | 4/1993 |
| WO | 9414016 | | 6/1994 |
| WO | 9727437 | | 7/1997 |
| WO | 02066907 | | 8/2002 |

* cited by examiner

COMPRESSION SYSTEM FOR COOLING AND HEATING PURPOSES

BACKGROUND OF THE INVENTION

1. Field of the Invention

The present invention relates to compression refrigeration system including a compressor, a heat rejector, an expansion means and a heat absorber connected in a closed circulation circuit that may operate with supercritical high-side pressure, using carbon dioxide or a mixture containing carbon dioxide as the refrigerant in the system.

2. Description of Prior Art

Conventional vapor compression systems reject heat by condensation of the refrigerant at subcritical pressure given by the saturation pressure at the given temperature. These refrigerants are most often selected so that the maximum pressure occurring in the system should be well below the critical pressure of the refrigerant and usually not exceeding a given limit, for example 25 bar.

When using a refrigerant with low critical temperature, for instance $CO_2$, the pressure at heat rejection will have to be supercritical if the temperature of the heat sink is high, for instance higher than the critical temperature of the refrigerant, in order to obtain efficient operation of the system. The cycle of operation will then be transcritical, for instance as known from WO 90/07683.

WO 94/14016 and WO 97/27437 both describe a simple circuit for realizing such a system, in basis comprising a compressor, a heat rejector, an expansion means and an evaporator connected in a closed circuit. $CO_2$ is the preferred refrigerant for both of them due to environmental concerns.

A major drawback for both WO 94/14016 and WO 97/27437 is that very high pressures will occur in the systems during standstill at high ambient temperatures. As explained in WO 97/27437, the pressure will typically be higher than 100 bar at 60° C. This will require a very high design pressure for all the components, resulting in heavy and costly components. Especially this is a drawback in design of hermetic compressors, for which the shell size is dictated by the size of the electrical motor.

WO 94/14016 describes how this can be improved by connecting a separate pressure relieving expansion vessel connected to the low side of the circuit via a valve. The disadvantage of this is that it will increase the cost and complexity of the system.

Yet another drawback of WO 94/14016 and WO 97/27437 is that the charge specifications, respectively 0.55 to 0.7 kg/l and 0.25 to 0.45 kg/l of internal volume of the system will result in too high charge to be optimal for systems for instance operating at lower temperatures of heat absorption and/or using hermetically sealed compressors, having a large gas volume on the low-side of the system.

Another drawback of WO 94/14016 and WO 97/27437 is that they do not take into consideration that the optimal charge of the system will be strongly influenced by the solubility of the refrigerant in the lubricant for systems with lubricated compressors and also by constructive elements of the system.

SUMMARY OF THE INVENTION

A major object of the present invention is to make a simple, efficient system that avoids the aforementioned shortcomings and disadvantages.

As stated above the invention is based on a simple circuit comprising at least a compressor, a heat rejector, an expansion means and a heat absorber. Based on the fact that the prior art references commented above deals with refrigeration circuits with high refrigerant charges, the inventors, through testing and simulations, surprisingly found that by adapting the internal volume of components that contain refrigerant vapor/gas during normal operation in the low pressure side of the system, optimal operating conditions can be obtained with a low charge for a given internal volume of the system. Thus the lowest possible design pressure for the constructive elements of the system can be obtained.

In this way a separate pressure relieving expansion vessel is not needed to avoid excess pressures at stand still conditions at high temperatures, and all components or parts of components in the low-side of the system can be designed for a lower pressure. Calculations and experiments show that maximum standstill pressure at a temperature of 60° C. easily can be kept below 80 bar with $CO_2$ as the refrigerant. The invention can be used to decrease the weight and cost of the system significantly, even with a simple design of the system.

BRIEF DESCRIPTION OF THE DRAWINGS

The invention will be further described in the following by way of examples only and with reference to the drawings in which.

DETAILED DESCRIPTION OF THE INVENTION

Figure 1:
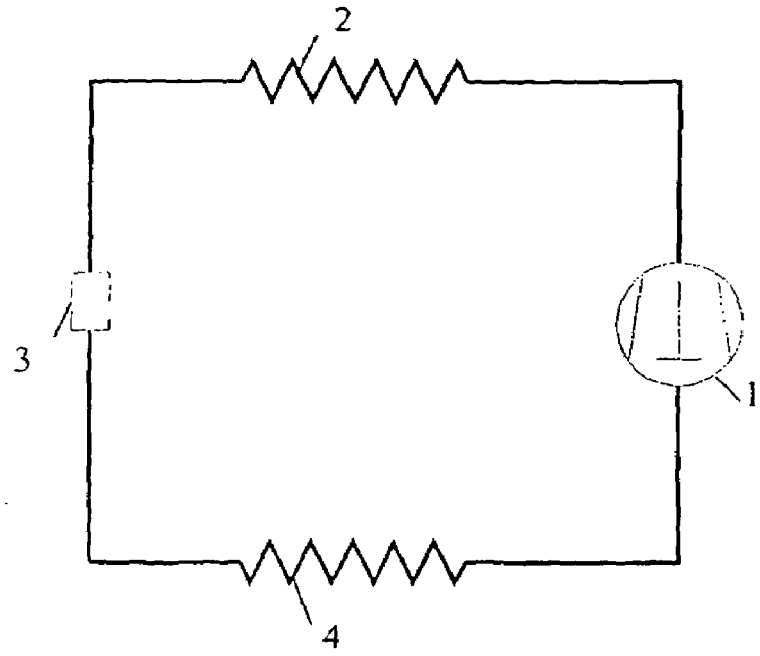
FIG. 1 illustrates a simple circuit for a vapor compression system.

FIG. 1 illustrates a conventional vapor compression system comprising a compressor 1, a heat rejector 2, an expansion means 3 and a heat absorber 4 connected in a closed circulation system.

When using for instance $CO_2$ as the refrigerant, the high-side pressure may sometime be subcritical, but such a system must be able to operate at supercritical high-side pressure at higher temperatures of the heat sink, in order to obtain optimal efficiency of the system. The high-side of the system must therefore be designed for a correspondingly high operating pressure, for $CO_2$ maybe typically in the range higher than 110 bar if air is used as a heat sink. The low-side of the system, however, will seldom require operating pressures higher than for instance 60 bar, corresponding to an evaporation temperature of about 22° C. The standstill pressure will then often dictate the design pressure of the low-side, since the system often must be able to withstand standstill temperatures up to 60° C. or higher. At these conditions, the pressure level may often be as high as the maximum operating pressure of the high-side of the system if the system may be exposed to these kinds of temperatures.

The importance of the maximum pressure for the design of components is demonstrated by some of the existing codes, standards and common practice. Commonly, five times the maximum pressure is required as the minimum burst pressure. A component that may be exposed to 120 bar will then be required to withstand 600 bar, while a component that may be exposed to 70 bar will only be required to withstand 350 bar. This may lead to a significant difference in manufacturing cost, size and weight. This will be especially important for components such as (semi)hermetic compressors, where the shell size is quite large, dictated by the electrical motor dimensions.

According to the invention it is possible to design the system with regard to refrigerant charge and volume of different components in order to reduce the maximum standstill pressure. Thus, the necessary design pressure for the low-side of the system may be reduced in a simple way, without departing from the optimum high-side pressure during operation of the system. This will contribute to a low-cost system with optimal efficiency.

The intention of the invention may be obtained by adapting the internal volume of components that contain refrigerant vapor/gas during normal operation in the low pressure side of the system, optimal operating conditions can be obtained with a low charge for a given internal volume of the system. Thus the lowest possible design pressure for the constructive elements of the system can be obtained. The volume may for instance be adapted as a larger sized tube, which is relatively inexpensive even for higher pressure ratings, in order to reduce the necessary shell design pressure of a hermetic compressor.

Figure 2:
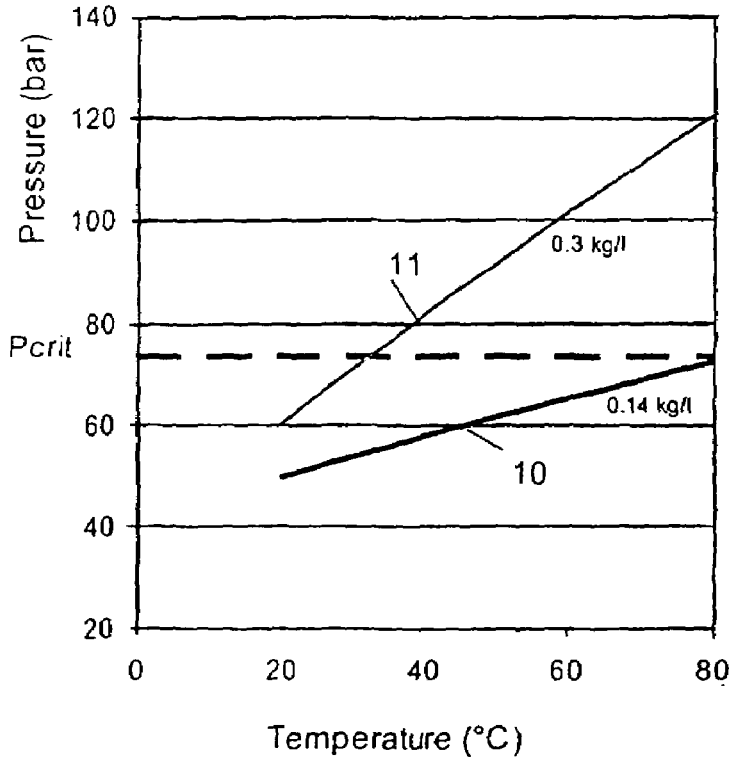
FIG. 2 shows an example of how the pressure varies in the system at stand still for varying temperature when designed according to the invention and compared with WO 97/27437.

FIG. 2 shows how the pressure in a system according to the invention may vary with the temperature for a system equalized in temperature at standstill, see the curve indicated by reference numeral 10. As may be seen, the pressure in the system even at very high ambient temperatures is below the critical pressure of the refrigerant. A typical curve 11 for a system according to WO 97/27437 is also included, for comparison. As can be seen the difference is significant.

Figure 3:
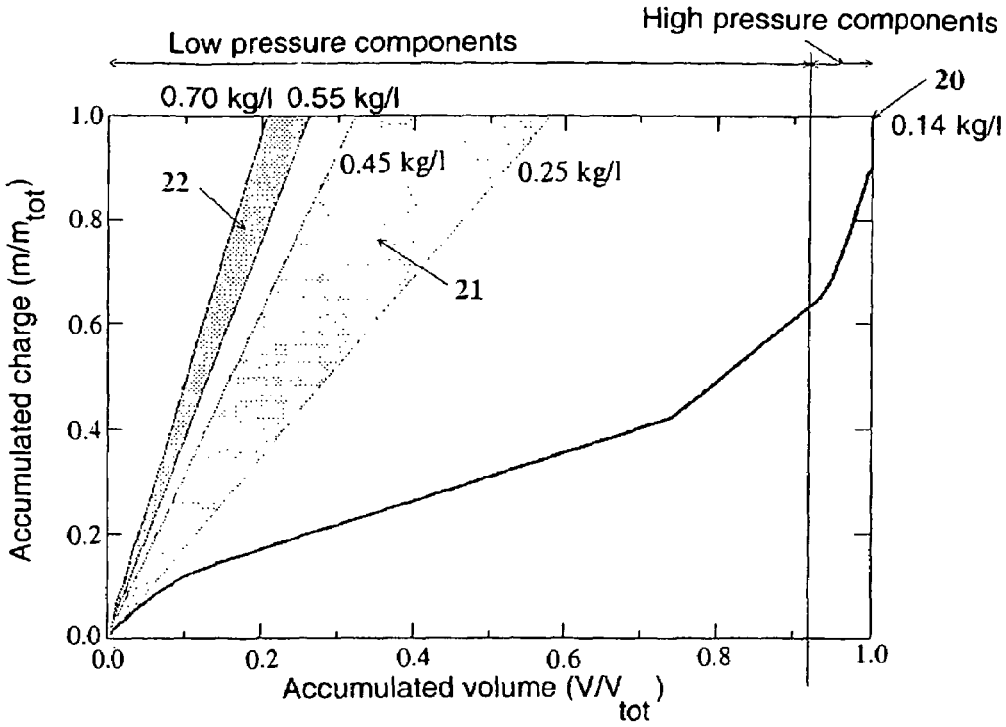
FIG. 3 illustrates how the volume and charge of the different components in a typical system according to the invention contribute to the charge of the system for an optimal system charge compared with the volume to charge ranges according to WO 94/14016 and WO 97/27437, as indicated by hatched areas in the diagram.

FIG. 3 shows how the accumulated charge/volume relation varies through the different parts of a selected system charged to give optimal efficiency in the design point for the system, according to the invention. As may be clearly seen; the end charge per internal volume in total for this system ends up at about 0.14 kg/l 20, which is well below the limits described in WO 94/14016 and WO 97/27437 and which is indicated by the hatched areas, 21 and 22, respectively.

Figure 4:
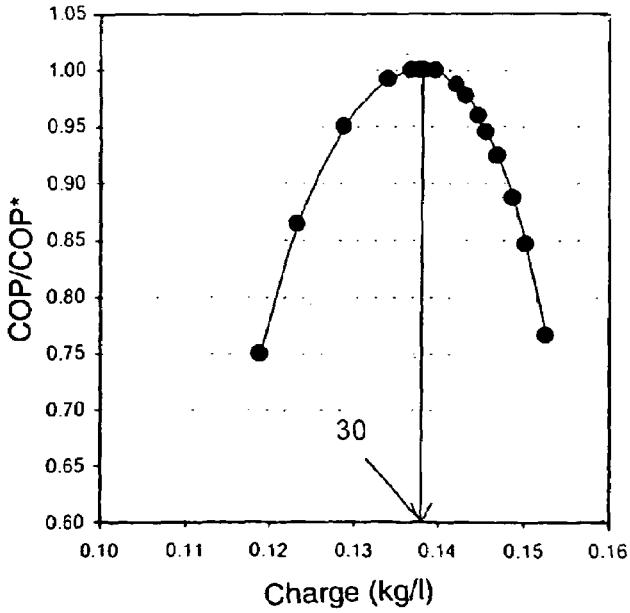
FIG. 4 illustrates the maximum coefficient of performance (COP) that is given by the optimal charge of the system and how the coefficient of performance will decrease if the filling is higher or lower than the optimal one.

FIG. 4 illustrates how the mentioned optimum charge 30 gives a maximum efficiency, COP, for a system according to the invention. COP is defined as the relation between cooling capacity for a refrigeration system and the power input to the system. When the charge is higher or lower, the COP decreases rapidly to a significantly lower value than the one given by the optimum charge.

FIGS. 2–4 are based on detailed simulations for a system according to the invention comprising a hermetic compressor, an internal heat exchanger, an evaporator and a gas cooler. FIG. 4 corresponds to values for the system when operated at ambient temperature +40° C. for heat rejection and with the evaporating temperature in the range −7° C. to −2° C. depending on the charge and capacity of the system. The operating high-pressure can vary between 70–120 bar depending on the charge and ambient temperature. The cooling capacity was about 700 Watt.

Since the optimum charge will depend on factors like operating conditions, constructive elements of the system and solubility of the refrigerant in the lubricant, the specification of a given charge per unit internal volume of the system is not very relevant or useful in practice. According to the invention the charge is related to a resulting maximum pressure in the system at a given temperature during standstill, meaning that the system has an equalized temperature that is the same for the whole system. According to the invention, this pressure should be lower than 1.26 times the critical pressure of the refrigerant when the temperature of the system is equalized to a temperature up to 60° C. The resulting pressure at his temperature, or any other temperature that is defined as the maximum standstill temperature, will be important in order to define the design pressure of the low-side of the system, as long as the value exceeds the maximum operating pressure of the low-side. For pure $CO_2$ this pressure limit corresponds to a pressure of about 93 bar at the given temperature.

No lower pressure limit is designated for the invention, since lower resulting pressures will satisfy the intentions of the invention, namely to achieve a lowering of the design standstill pressure. However, it is not likely that the standstill pressure at this temperature, 60° C., may be lower than 0.14 times the critical pressure, for pure $CO_2$ corresponding to about 10 bar.

Several improvements in the efficiency or the operating conditions of the system can be obtained using different types of components, like variable capacity compressors, expansion machines, different throttling means, internal heat exchangers, throttling to intermediate pressure or other cycle improvements. Still it will be possible to reduce the design pressure of several parts of the system, and thereby reduce the system cost to a minimum. This will also be valid for a receiver included in the low side of the system, if it is preferable for some reason to include a receiver in the system, not as a separate vessel intended to serve as an expansion vessel, as described in WO 94/14016, but as an integral part of the circulation loop of the system.

Figure 5:
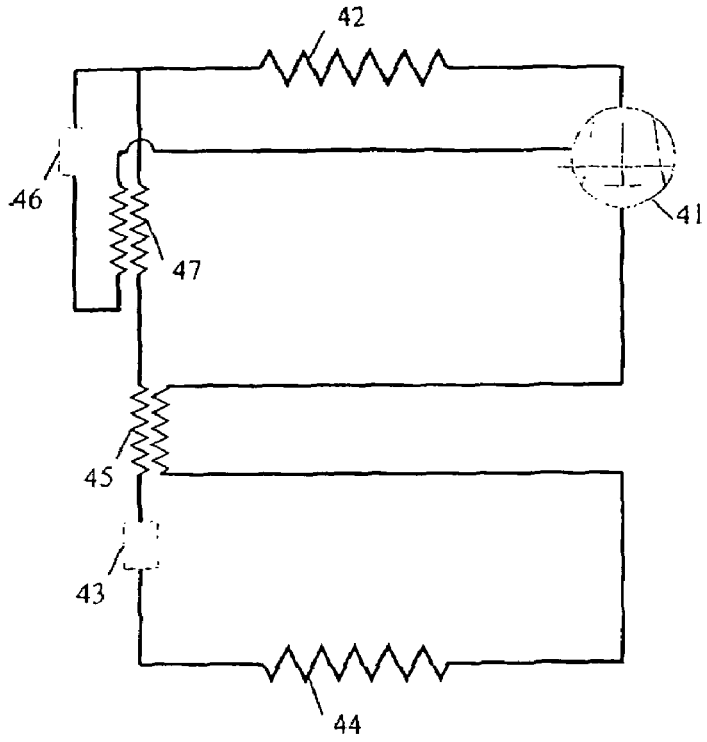
FIG. 5 is an example of a modified cycle in order to improve system operation.

FIG. 5 shows one possible system configuration with a modified cycle. The example system comprises a two-stage compressor 41, a heat rejector 42, an expansion means 43, a heat absorber 44, an internal heat exchanger 45, another expansion means 46 and an internal sub-cooler 47. The throttling to intermediate pressure is done in order to subcool the high-pressure refrigerant before throttling in the sub-cooler 47, and to reduce the final temperature of compression through the injection of intermediate pressure gas during the compression or between the two stages of a double-stage compressor 41. According to the invention the design pressure of the components at intermediate pressure may also be reduced, for example the intermediate pressure side of the heat exchanger 47 and the parts of the compressor 41 exposed to the intermediate pressure.

Figure 6:
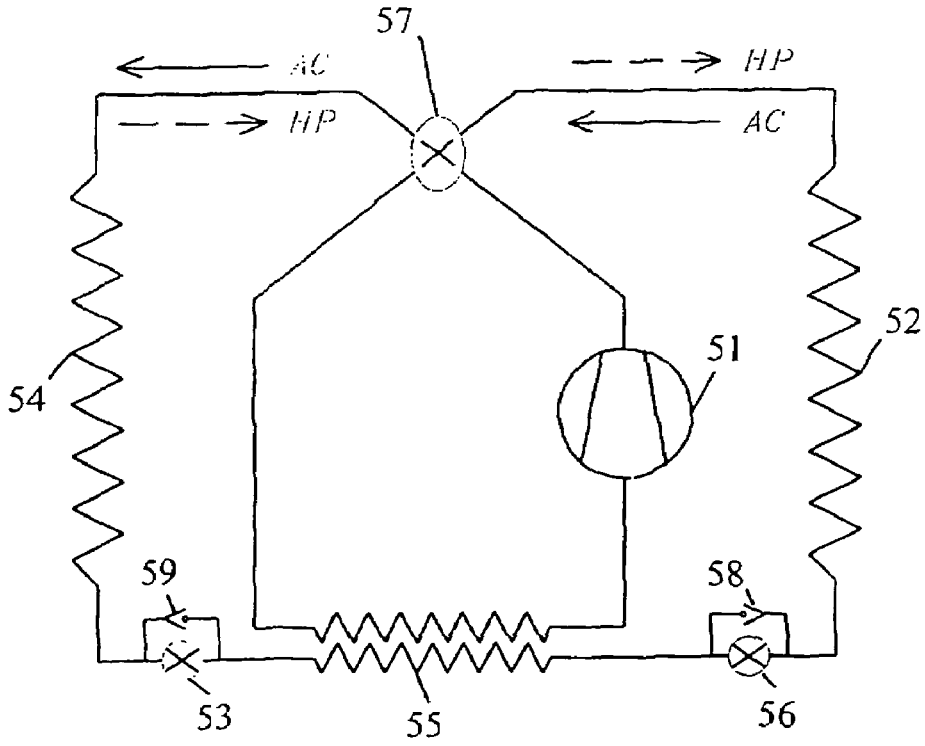
FIG. 6 is an example of a reversible system air conditioning and heat pump system.

A system characterised in that the system operation may be reversed, for example as shown in FIG. 6, may also benefit from the invention. The example shows a reversible heat pump system comprising a compressor 51, a heat exchanger 52, an expansion means 53, a heat exchanger 54, an internal heat exchanger 55, another expansion means 56, a four-way valve 57, a one-way valve 58 and another one-way valve 59. The suction side of the compressor will always be at the low pressure in the system and may thus benefit from a lower design pressure as described earlier.

The heat exchanger 52, which in cooling mode is the evaporator/heat absorber, in the low-side of the system, will in heating mode be on the high-side of the system. The maximum high pressure in heating mode is, however, often as low as maybe 70–80 bar, thus, a lower maximum standstill pressure according to the invention will therefore also be beneficial for this component.

The preferred refrigerant according to the invention is carbon dioxide, but the invention can also be used for mixtures of carbon dioxide and other fluids, that may exhibit the same characteristics, operating in a transcritical cycle during certain operating conditions.

It should be stressed that the use of the invention is not limited to the examples and figures explained in the preceding description, but within the scope of the claims the invention is applicable to all systems where the intention of the invention may be utilized.

The invention claimed is:

1. A compression refrigeration system including a compressor (1), a heat rejector (2), an expansion means (3) and a heat absorber (4) connected in a closed circulation circuit that is operable with supercritical high-side pressure wherein the refrigerant charge and component design of the system corresponds to a standstill pressure inside the system which is lower than 1.26 times the critical pressure of the refrigerant when the temperature of the whole system is equalized to 60° C.; and carbon dioxide or a refrigerant mixture containing carbon dioxide is applied as the refrigerant in the system.

2. The system according to claim 1, wherein the compressor comprises a multi-stage or variable capacity compressor.

3. The system according claim 1, wherein the compressor is of a semi-hermetic or hermetic design.

4. The system according to claim 1, wherein the system also comprises an internal heat exchanger.

5. The system according to claim 1, wherein it is designed for transcritical operation.

6. The system according to claim 1, wherein a receiver or extra component provide extra volume in the system.

7. The system according to claim 1, using $CO_2$ as refrigerant wherein the charge of the system is between 18 and 250 grams per liter of the total internal volume of the system.

8. The system according to claim 1, wherein the cycle modifications include throttling to intermediate pressure is done in order to improve efficiency and or operating conditions.

9. The system according to claim 1, wherein the system operation may be reversed.

10. A compression refrigeration system comprising:

a compressor;

a heat rejector connected to a first side of the compressor;

an expansion means connected to the heat rejector; and a heat absorber connected to the expansion means and a second side of the compressor; and a refrigerant in the system including a quantity of carbon dioxide or a refrigerant mixture containing carbon dioxide, wherein the compressor, heat rejector, expansion means and heat absorber are connected in a closed circulation circuit that is operable with supercritical high-side pressure, and wherein the refrigerant charge and the design of each of the components in the closed circulation circuit design of the system corresponds to a standstill pressure inside the system which is lower than 1.26 times the critical pressure of the refrigerant when the temperature of the whole system is equalized to 60° C.

* * * * *